United States Patent [19]

Claiborne

[11] 4,244,692

[45] Jan. 13, 1981

[54] PROCESS FOR MANUFACTURING FLAME-RETARDANT YARN

[75] Inventor: J. Lyle Claiborne, Hixson, Tenn.

[73] Assignee: Dixie Yarns, Inc., Chattanooga, Tenn.

[21] Appl. No.: 927,616

[22] Filed: Jul. 24, 1978

[51] Int. Cl.[3] ..... D06M 1/00; B05D 3/04; C09K 3/28

[52] U.S. Cl. ..... 8/116 P; 8/470; 118/58; 427/324; 427/341; 427/342; 427/354; 427/396; 427/401

[58] Field of Search ..... 427/390 D, 392, 394, 427/396, 341, 342, 353, 354, 401, 324; 118/58; 8/116 P, 54.2

[56] References Cited

U.S. PATENT DOCUMENTS

| | | | |
|---|---|---|---|
| 1,334,190 | 3/1920 | Swartout | 28/76 X |
| 1,560,575 | 11/1925 | Hohnann | 28/76 X |
| 2,586,800 | 2/1952 | Elvin et al. | 68/5 |
| 2,688,863 | 9/1954 | Luther | 68/22 |
| 3,124,859 | 3/1964 | Corbiere et al. | 28/59.5 |
| 3,258,943 | 7/1966 | Claiborne | 68/20 |
| 3,284,820 | 11/1966 | Claiborne | 8/151.2 |
| 3,337,931 | 8/1967 | Claiborne | 28/76 |
| 3,607,356 | 9/1971 | Beninate et al. | 427/342 X |
| 3,701,268 | 10/1972 | Treptow et al. | 68/5 D |
| 3,763,669 | 10/1973 | Bous et al. | 68/5 D |
| 3,817,061 | 6/1974 | Bruner | 68/5 D |
| 3,846,155 | 11/1974 | Wagner | 427/342 X |
| 3,851,453 | 12/1974 | Robinson | 57/34 R |
| 3,933,122 | 1/1976 | Wagner | 427/341 X |
| 3,982,410 | 9/1976 | Getchell et al. | 68/5 D |
| 4,068,026 | 1/1978 | Wagner | 427/341 |
| 4,123,574 | 10/1978 | Wagner | 427/341 |

FOREIGN PATENT DOCUMENTS

| | | | |
|---|---|---|---|
| 641354 | 6/1962 | Italy | 68/5 D |

OTHER PUBLICATIONS

Proceeding of 14th Textile Chemistry & Processing Conference, New Orleans, La., Apr. 29, 30, May 1, 1974, pp. 163–175.

*Flame retardants*, C & EN, Apr. 24, 1978, pp. 22–36.

*Flame-retardant Yarns & Thread*, International Dyer & Textile Printer, Oct. 4, 1974, pp. 368–369.

"Banning Tris", *Newsweek*, Apr. 18, 1977, p. 67.

*Primary Examiner*—Michael R. Lusignan

*Attorney, Agent, or Firm*—Stevens, Davis, Miller & Mosher

[57] ABSTRACT

A system for ammoniating and curing flame-retardant impregnated single textile yarns by steps including impregnating the yarn with THPOH, drying the impregnated yarn, and ammoniating the THPOH-impregnated yarn by passing a single end of the yarn through a small tube leading into an ammoniation chamber wherein there is located a spool and means for rotating said spool for winding the ammoniated yarn onto the spool, the small tube being reciprocatable to traverse the length of the spool for uniformly winding the yarn on the spool.

9 Claims, 2 Drawing Figures

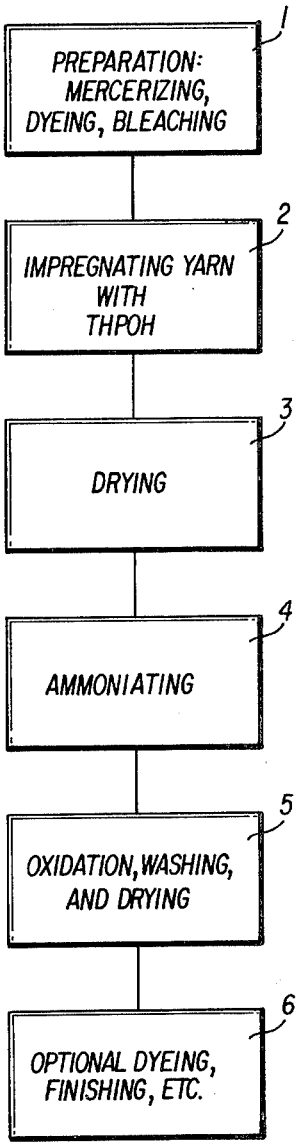
FIG. 1
FIG. 2
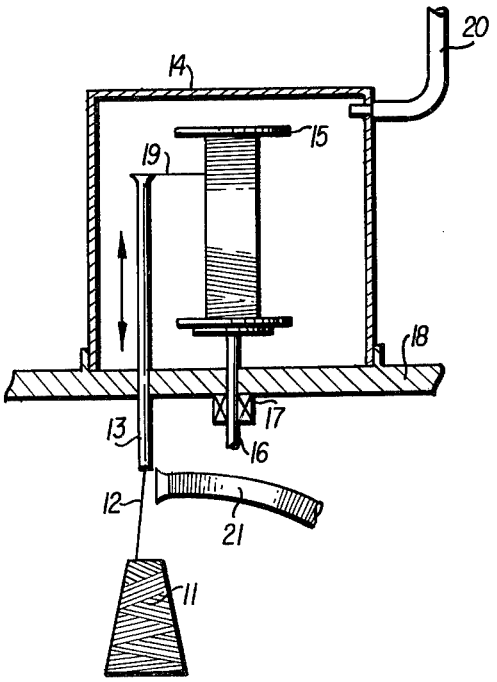

PROCESS FOR MANUFACTURING FLAME-RETARDANT YARN

The present invention relates to apparatus and a process or method for treating yarn from which flame-retardant fabrics and garments may be made. Throughout this specification and the appended claims, the word "yarn" is used generically to denote both yarns and threads for fabric making and sewing purposes.

While flame-retardant textile fabrics are important for obvious safety reasons, the importance of producing flame-retardant fabrics and garments has recently increased due to legislation and federal regulation, and there is a demand for cotton yarns which meet those requirements. Heretofore, cotton for use in fabrics and garments has usually been treated in fabric form, usually in woven fabric form. However, it is desirable to provide yarns which themselves exhibit flame-retardant characteristics and can therefore impart such characteristics to any fabric woven or knitted therefrom and garments made from such fabrics and yarns or threads.

Among the chemical processes for making flame-retardant cotton materials the "THPOH—$NH_3$" process is now widely used. THPOH is tetrakis (hydroxymethyl) phosphonium hydroxide. In the THPOH—$NH_3$ process a product, reportedly a polymer, is precipitated and later oxidized. While the THPOH—$NH_3$ treatment has been reported to be highly satisfactory in flameproofing cotton fabric, the chemistry of this system is still not fully understood. See Vail, S. L. et al, THPC-TYPE FINISHES; AN EXAMINATION OF REACTIONS OCCURRING DURING FINISHING, Proceedings of the 14th Textile Chemistry and Processing Conference, Apr. 29, 1974, ARS-S-60, February 1975, pp 163–167.

THPOH can be prepared for application to textile materials by reacting an aqueous solution of tetrakis (hydroxymethyl) phosphonium chloride (THPC) with an approximately equimolar quantity of a base such as sodium hydroxide. That reaction is believed to form an equilibrium mixture of tris(hydroxymethyl) phoshine (THP) and THPOH, which solution is applied as the THPOH, see Wagner, U.S. Pat. No. 3,846,155. After application of the THPOH solution to cellulosic textile material, the impregnated material is dried to a low moisture content, and then exposed to gaseous ammonia ($NH_3$) wherein a precipitating reaction product is formed on the textile material. Curing of the precipitated impregnate occurs in the ammonia atmosphere. After curing, the treated material is oxidized, washed and dried, and then may be subjected to more conventional coloring and finishing techniques as desired.

However, the THPC starting material for the above-described process has been found to be a carcinogen and is no longer widely used or available. In its place the THPOH—$NH_3$ process has been attempted starting with tetrakis (hydroxymethyl) phosphonium sulfate (THPS), which is then reacted with a base to form a somewhat different THPOH solution which has been used in the same general sequence of steps as described above. However, the THPOH—$NH_3$ process originating from THPS has not been as successful as was originally hoped.

There is a significant gulf between the theoretical use of THPOH flame-retardants and their practical applications, particularly in applying the THPOH system in commercially practical processes and equipment. The old THPC based formulations were known for problems in the drying step. The newer THPS based formulations have encountered various difficulties, one of which has been the inability to successfully control the ammoniation step which drives the essential reaction. Like the chemistry itself, the reasons for these problems are not fully understood.

The THPOH system were originally developed for application to fabrics, especially woven fabrics. However, the obvious methods by which THPOH would be applied to individual yarns or threads have been attempted with little, if any, success. See Calamari, T. A. et al FLAME RETARDANT FINISH FOR YARNS AND SEWING THREAD, Proceedings of the 14th Textile Chemistry and Processing Conference, Apr. 29, 1974, ARS-S-60, February 1975, pp 167–169. Calamari attempted THPOH—$NH_3$ treatment of cotton yarns using both the ball-warp treatment and package treatment techniques. In the ball-warp technique an untwisted bundle of 378 parallel ends of fiber are towed through a bath of the THPOH solution for impregnation. In the package treatment technique a wound package of the yarn is impregnated center-to-periphery or vice versa. But neither of those techniques satisfactorily uniformly impregnates the yarns.

The problem of uniformity is also present in the ammoniation-curing step of the THPOH process. Even if a yarn is uniformly impregnated with the THPOH application solution, if insufficient ammonia reaches portions of the yarn, the impregnate solution is insufficiently reacted and cured resulting in inadequately flameproofed yarn. Ammoniation of ball-warped yarns in a continuous ammoniator, or of packages of yarn in a static ammoniation chamber produces unsatisfactory results. Other methods have been attempted for continuously ammoniating a single yarn or thread, those shown in Wagner U.S. Pat. No. 3,846,155 or the Claiborne vertical ammoniator being such examples. But those systems have also been unsatisfactory, particularly in ammoniating and curing THPOH impregnated yarns in systems where the THPOH impregnate solution originated from THPS.

BRIEF SUMMARY OF THE INVENTION

It is an object of the present invention to satisfy the defects and cure the needs of the aforementioned prior THPOH—$NH_3$ flame-retardant processes.

It is an object of the present invention to provide an improved ammoniator apparatus.

It is another object of the present invention to provide a system for uniformly ammoniating and curing a THPOH flame-retardant impregnate on a single textile yarn.

The foregoing objects and others are achieved in a system for ammoniating and curing flame-retardant impregnated single textile yarns by steps including impregnating the yarn with THPOH, drying the impregnated yarn, and ammoniating the THPOH-impregnated yarn by passing a single end of the yarn through a small tube leading into an ammoniation chamber wherein there is located a spool and means for rotating said spool for winding the ammoniated yarn onto the spool, the small tube being reciprocatable to traverse the length of the spool thereby uniformly winding the yarn on the spool.

BRIEF DESCRIPTION OF THE DRAWINGS

The foregoing objects and others will be explained in conjunction with the accompanying drawings of the present invention; wherein:

FIG. 1 is a schematic flow-chart showing steps in the process of the present invention.

FIG. 2 is a partially schematic, partially cross-sectional drawing of the apparatus of the present invention.

DETAILED DESCRIPTION

The process steps of the present invention are illustrated in flow-chart form in FIG. 1. Before any flame-retardant materials are added to the individual textile yarns, it may be desirable or advantageous to prepare the yarns to be flame-proofed by conventional textile processing steps such as mercerizing, drying, bleaching and the like, as indicated in step 1 of FIG. 2. After any such preparation steps are complete, the flame-retardant impregnating materials are applied as indicated in step 2 of FIG. 1. Applicant has found that an efficient way of applying THPOH to single strands or yarns of textile material is by use of the apparatus described in his earlier U.S. Pat. No. 3,337,931. After application of the THPOH, the amount of fluid applied may be controlled at a desired level by passing the yarn over an air stripper as described in U.S. Pat. No. 3,284,820.

While it may be possible to utilize the present invention in conjunction with any flame-retardant system, including THPOH—$NH_3$ flame-retardant systems derived from any initial source materials, the present invention is particularly advantageous for use with THPOH—$NH_3$ flame-retardant impregnate solutions derived from THPS. As previously indicated, such impregnate solutions may be prepared by reacting tetrakis (hydroxymethyl) phosphonium sulfate (THPS) with any suitable base, such as sodium hydroxide, potassium hydroxide or other suitable inorganic or organic bases.

A more specific example of the THPS-based THPOH—$NH_3$ system is known as Hooker Process #7, as described in a paper to be presented at the September, 1978 meeting of the American Association of Textile Color Chemists. In Hooker Process #7 a typical pad bath comprises:

THPS-75*: 600 lb.
Water: to desired concentration
Urea: 67 lb.
Disodium Phosphate: 50 lb.
Caustic 50%: 106 lb.
Wetting Agent: Optional

*Reg. TM of Hooker Chemical Corp.

The THPS is the primary flame-retardant agent, containing about 11.6% phosphorous. The urea first ties up formaldehyde in the bath to produce a nearly odorless bath, and during the later drying step condenses with THP to form a partially cured polymer, or prepolymer. This prepolymer prevents vaporization loss of THP, thereby reducing odors and undesirable build-up of residual material in the dryer. The sodium phosphate acts as a buffer, preventing low fiber pH in the event of process stoppage in the dryer with subsequent tendering. The caustic, as discussed above, neutralizes the THPS to a pH of about 7.4.

In the Hooker Process #7 the components are added in the order stated above to a well-stirred mix tank. After charging the THPS-75, water is added, followed by the urea. After the urea has dissolved, the disodium phosphate is added rather carefully so that it does not cake on the bottom of the tank. The aqueous caustic is then added slowly over a period of 10–15 minutes. A fixed restriction in the caustic feed line prevents excessively fast addition of the caustic, since too rapid addition causes hydrolysis and destruction of some of the THPS. The fresh pad bath smells strongly of formaldehyde, and if the mix tank is not covered and the pad area not well ventilated, formaldehyde odors can be prevalent. However, after 2–4 hours aging, the formaldehyde odors above the pad bath disappear and will remain so for about 2 days, after which they will again begin to reappear. Thus, by proper scheduling and installation of a holding tank, formaldehyde odors can be suppressed. The pad bath can be fresh or aged up to 3 days. Process #7 is said to be insensitive to drying conditions. Process #7 is said to allow complete or over drying so that the yarn or fabric can contain essentially no moisture. Curing in ammonia at 70–90% concentration then proceeds. Oxidation with hydrogen peroxide and rinsing with hot water completes the process. But even the Hooker #7 has not been found to be completely satisfactory, there apparently still being difficulties in the ammoniation-curing step of the process. However, when the Hooker Process #7 is used in conjunction with the system of the present invention, quite satisfactory results have been achieved.

In the system of the present invention, yarn is drawn into the apparatus described in my U.S. Pat. No. 3,337,931 which applies thereto THPOH produced by Hooker Process #7 formula, or any other suitable formula. This apparatus provides approximately 100% wet pick-up, after which the yarn is dried over the electrically heated drying rolls of the apparatus described in the '931 patent.

The THPOH impregnated yarn may then be passed directly to the advantageous ammoniation apparatus of the present invention, or taken up on a pirn carrier, i.e., wound into a spool or cheese form, from which it may subsequently be passed into the ammoniation apparatus.

The advantageous apparatus of the present invention is partially schematically illustrated in FIG. 2 wherein a cheese of THPOH impregnated yarn 11 is shown with an individual end 12 thereof being fed into the inlet tube 13 of ammoniation chamber 14. It will be understood that the single end 12 of THPOH impregnated yarn being fed into inlet tube 13 could be emerging directly from the THPOH impregnation and drying steps, i.e., in a continuous process, rather than from a cheese 11 or other storage system. The inlet tube 13 is reciprocable and can be thought of as a parallel winder traverse system for evenly distributing the treated yarn on spool 15 which is located entirely within ammoniation chamber 14. Spool 15 is mounted on a rotatable spindle 16 which in turn is mounted in a suitable bearing 17 which is fixed with respect to the chamber 14 or its base 18. Drive means (not shown) are capable of rotating spindle 16 at variable rates of speed, and the drive means are coordinately linked with the system (not shown) for reciprocating inlet tube 13, so that the speed of rotation of spool 15 and the speed of traverse of the end of inlet tube 13 are coordinated to wind treated yarn 19 evenly on spool 15.

Ammonia is pumped into chamber 14 through inlet tube 20 at a desired rate, and any ammonia which escapes through inlet tube 13 is evacuated by a suction system 21 schematically illustrated at 21, near the exterior end of inlet tube 13. Chamber 14 is constructed so that it may be clamped or otherwise semi-permanently sealed to its base 18, to prevent escape of ammonia gas during yarn processing, but to facilitate changing of yarn spools 15. The ammonia gas pumped into the chamber is such as to maintain the ammonia atmosphere in the chamber at a concentration of at least about 50% $NH_3$, and preferably about 70% $NH_3$.

The advantageous ammoniator of the present invention provides results which are surprisingly more satisfactory than similar systems using either single yarn ammoniators such as vertical column ammoniators, or static package ammoniators. In the present invention, the single strand of THPOH impregnated yarn is not only individually ammoniated as it passes through inlet tube 13 and chamber 14, but also the yarn is treated in package form as it remains in the ammoniator chamber during winding on spool 15. The winding in the ammonia atmosphere within the chamber provides the additional possibility that some ammonia from that atmosphere is physically trapped within the yarn as it is wound on spool 15. The duration of ammonia treatment may thus be effectively long enough, but the speed of winding, and therefore speed of passage of an individual end of yarn into the treatment zone, may be greatly increased over previously used ammoniation systems. For example, while yarn might be treated at speeds up to about 250 yards per minute, in the old vertical column type ammoniators, the system of the present invention may be used, with even better results in terms of the quality of flame-retardant yarn produced thereby, at speeds of about 1000 to 1300 yards per minute, and has been operated at speeds on the order of about 2000 or more yards per minute. Even at such speeds the THPOH impregnated yarn is adequately and uniformly treated with the ammonia in the ammoniation chamber, and the single end treatment adequately provides for dissipation of the heat created by the exothermic curing reaction.

After being ammoniated, as described above, the yarn is treated in a standard package dyeing machine using an oxidant such as hydrogen peroxide, whereafter the treated yarn is washed and dried to any desired extent. The thus flame-retardant yarn may then be dyed or finished by any suitable means that may be desired.

As previously indicated, a very significant problem in prior THPOH treatment systems was achieving uniformly treated yarn. A simple method of visually detecting the uniformity of treatment is to use an acid dye such as acid dye No. 14, which will color yarns bearing THP deposited by the THPOH—$NH_3$ process, revealing the quality and extent of deposition by the density or intensity of color remaining after dyeing. This dye test is quite useful on fabrics flameproofed by the THPOH—$NH_3$ process.

Additionally, flame-retardant fabrics made using the present invention or any other system may be tested according to federal standards such as that stated in 16 C.F.R. 1615 (FF 3-71) for children's sleepwear fabrics. According to that test five separate fabric specimens each 3.5×10 inches is vertically suspended in a special cabinet and the bottom edge of each specimen is exposed for three seconds to a small gas flame. Satisfactory flame-retardant fabrics cannot have an average char length for the five specimens of more than seven inches, and no single specimens may completely char. Satisfactory fabrics must meet these limits even after 50 washings and dryings.

The following examples further specifically describe the system of the present invention for manufacturing flame-retardant yarn, particularly all-cotton flame-retardant yarn. The parts and percentages are by weight unless otherwise indicated. These examples are intended to illustrate various embodiments of the inventive system.

EXAMPLES 1-19

A THPOH flame-retardant impregnate composition is prepared by combining the following components generally according to the method of Hooker Process #7 outlined above herein:

| | | |
|---|---|---|
| THPS 75 | | 1200 g. |
| Sodium Phosphate | | 100 g. |
| Urea | | 134 g. |
| Sodium Hydroxide | | 212 g. |
| Water | | 722 g. |
| | Total | 2368 g. |

The THPOH composition resulting from the formulation is applied to single strands of all-cotton yarn at a speed of about 1300 yards per minute using the coating apparatus described in my U.S. Pat. No. 3,337,931, and dried therewith at a temperature of about 250° F., thereby resulting in a phosphorus pick-up of about $3\frac{1}{2}$-4% based on the yarn weight.

While any suitable THPOH concentration may be used in the so-called pad bath, it has been found that THPOH concentration in the range of about 25-35%, gives particularly good results.

The THPOH impregnated yarn is then wound into a cheese, and single strands thereof are treated in an ammonia atmosphere in the apparatus described in conjunction with FIG. 2, above herein. The chamber 14 in the ammoniator has an about 5 gallon capacity, and the inlet tube traverses through a distance of about 10 inches to evenly wind the ammoniated-THPOH treated yarn onto the spool 15 within the chamber. The ammonia feed rates and yarn feed and winding rates are specified in TABLE I, below.

After collection of the ammoniated-THPOH treated yarn, it is oxidized with hydrogen peroxide, washed with hot water and dried, all by conventional techniques.

The thus treated flame-retardant yarn is then knitted into standard weft (tubular) knit jersey fabric, and samples thereof are tested according to Department of Commerce Test FF 3-71. The data in TABLE I illustrates the outstanding flame-retardant results achieved on all-cotton yarns treated using the present invention. In all tested cases the resultant flame-retardant yarns were within the limitations of FF 3-71 up through 25 washings, and most examples also satisfied FF 3-71 even through 50 washings.

TABLE I

| Example | Yarn Description | Pad Bath Conc. % THPOH | $NH_3$ Flow scfh | Yarn Speed ypm ($NH_3$) | Fabric wght. oz./yd$^2$ | Nos. of launderings 0 × P%[a] | 10 × CL.[b] | 10 × %P | 25 × CL. | 25 × % P | 50 × CL. | 50 × P% |
|---|---|---|---|---|---|---|---|---|---|---|---|---|
| 1 | 36/2 Bleached 100% cotton, merc | | | | | | | | | | | |

TABLE I-continued

| Example | Yarn Description | Pad Bath Conc. % THPOH | $NH_3$ Flow scfh | Yarn Speed ypm ($NH_3$) | Fabric wght. oz./yd$^2$ | Nos. of launderings 0 × P%[a] | 10 × CL[b] | 10 × %P | 25 × CL | 25 × % P | 50 × CL | 50 × P% |
|---|---|---|---|---|---|---|---|---|---|---|---|---|
| | (mercerized) | 26 | 10 | 430 | | 2.9 | | | | | 2.6 | BEL[c] |
| 2 | 36/2 Bleached 100% cotton, merc. (mercerized) | 28 | 10 | 430 | | | | | | | | 3.7 BEL[e] |
| 3 | | 30 | 10 | 430 | | 3.7 | | | | | 3.2 | BEL |
| 4 | 36/2 Bleached 100% cotton, merc. (mercerized) | 32 | 10 | — | 5.4 | 3.8 | 3.0 | 1.2 | | 2.0 | 3.0 | 2.5 BEL |
| 5 | 36/2 Bleached 100% cotton, merc. (mercerized) | 32 | 10 | — | 5.7 | | 1.5 | 1.4 | | 1.3 | | 3.0 |
| 6 | 36/2 Bleached 100% cotton, merc. (mercerized) | 32 | 10 | — | 8.5 | | 0.5 | 0.5 | | 0.6 | | 0.9 |
| 7 | 36/2 Bleached 100% cotton, merc. (mercerized) | 30 | 10 | — | 5.5 | | 1.5 | 1.4 | | 5.0 | | 3.0 |
| 8 | 36/2 Bleached 100% cotton, merc. (mercerized) | 30 | 10 | — | 6.1 | | 0.5 | 1.0 | | 2.5 | | 3.0 BEL |
| 9 | 36/2 Bleached 100% cotton, merc. (mercerized) | 30 | 10 | — | 8.8 | | 0.4 | 0.4 | | 0.6 | | 0.4 |
| 10 | 20/2 Bleached 100% cotton, merc. | 32 | 10 | 430 | — | | <1 | | | | | <1 |
| 11 | Dyed Blue merc. | 32 | 10 | 430 | — | | <1 | | | | | <1 |
| 12 | Bleached merc. | 32[d] | 10 | 430 | — | | <1 | | | | | <1 |
| 13 | Bleached merc. | 30 | 10 | 430 | — | | <1 | | | | | <1 BEL |
| 14 | Merc. natural (greige) | 30 | 10 | 430 | — | | 1.4 | | | | | <1 BEL |
| 15 | 20/2 Vat Black 100% cotton, merc. | 32 | 10 | 430 | | | | | | | | 1.9 |
| 16 | 20/2 Reac Black 100% cotton, merc. | 32 | 10 | 430 | | | | | | | | 0.4 |
| 17 | Bleached merc. | 32 | 10 | 430 | | | | | | | | 0.8 |
| 18 | Merc. natural (greige) | 32 | 10 | 430 | | | | | | | | BEL |
| 19 | 20/2 Reac Black 100% cotton merc. | 32 | 10 | 1000 | | | | | | | | <1 |

[a]Percent phosphorus on treated yarn.
[b]Char Length according to Department of Commerce Test FF 3-71, 16 C.F.R. 1615.
[c]Burned entire length
[d]Softener added to pad bath
[e]Such double reported data means that the numerical average was achieved, but in one test one sample burned entire length.

This was true even at speeds of 1000 yards per minute or more. Additionally, the present invention enhances efficiency of the THPOH—$NH_3$ system by optimizing the amount of THPOH that need be applied, and by minimizing the amount of $NH_3$ that need be used for curing.

It should be pointed out that yarns quite often must be dyeable after having been flame-retardant treated. Hence the dyeing properties of the yarn must be consistent, and it has historically been more difficult to produce an evenly dyeable yarn than it is to produce a yarn with enough consistency in fire-retardant characteristics. Yarns treated in the present inventive system not only exhibit uniform fire-retardant characteristics, but are also quite uniformly dyeable.

While the present invention is particularly suitable for flame-retardant treatment of all-cotton yarns with the THPS based THPOH—$NH_3$ flame-retardant system, other yarns or other flame-retardants might be used with various components of the system.

In addition to the above described system for manufacturing flame retardant individual yarn ends, a similar system may be used for semi-continuously ammoniating, and thereby flame proofing, lengths of woven or knitted fabric. While the preparatory and chemical application steps are quite similar to those described above herein, the ammoniation step is carried out in a chamber which includes a fabric take-up device, rather than an individual yarn take-up device. In this fabric ammoniator, the axis about which treated fabric is wound during take up is preferably horizontal, and the fabric enters the chamber through a slit or thin manifold, whose width is slightly larger than the fabric width. Since the fabric is taken-up simultaneously throughout the length of the rotating take-up device, there is no need for a reciprocating entry tube or manifold as is used in the system for treating a single yarn end. The fabric treatment chamber is of course large enough to enclose a completely wound roll of treated fabric, and the chamber includes sealably attachable and detachable base and cover portions, thereby permitting removal of completely wound rolls of fabric. Means for evacuating excess ammonia are located near the fabric entrance opening of the chamber. As in the single end treatment system, this fabric treatment system provides all of the advantages of single pass fabric treatment and batch wound fabric treatment, as well as additional advantages. The system can treat fabric at higher speeds than previously known fabric flame proofing treatment systems using similar chemistry.

Although specific components, proportions and arrangements of elements have been stated in the above description of preferred embodiments of this invention, other equivalent components and arrangements of elements may be used with satisfactory results and various degrees of quality, or other modifications may be made herein to enhance the construction of the invention to thereby increase its utility. It will be understood that such changes of details, materials, arrangements of parts, and uses of the invention described and illustrated herein, are intended to be included within the principles and scope of the claimed invention.

What is claimed is:

1. The process of flame-retardant treating textile yarn, comprising:

impregnating a single end of yarn with an aqueous tetrakis (hydroxymethyl) phosphonium hydroxide composition derived from tetrakis (hydroxymethyl) phosphonium sulfate, drying the impregnated yarn to reduce its water content, then ammoniating the dried impregnated yarn by passing a single end of yarn into an inlet tube of an ammoniating apparatus through said inlet tube into an ammonia filled changer wherein the yarn is substantially evenly wound on a spool while still within said ammoniation chamber, removing the impregnated and ammoniated yarn from said chamber, oxidizing the ammoniated impregnate, and washing the yarn with water, thereby producing an uniformly flame-retardant textile yarn.

2. The process of claim 1, wherein the concentration of tetrakis (hydroxymethyl) phosphonium hydroxide in said aqueous composition is between 25 and 35% by weight.

3. The process of claim 2, wherein said concentration is about 32%.

4. The process of claim 1, wherein the dried impregnated yarn enters the inlet tube and is wound onto a spool at a speed in excess of 1000 yards per minute.

5. The process of claim 1, wherein the dried impregnated yarn enteres the inlet tube and is wound onto a spool at a speed in excess of 2000 yards per minute.

6. The process of claim 1, wherein ammonia is fed into said chamber at a rate of approximately 10 standard cubic feet per hour.

7. The process of claim 1, wherein the concentration of tetrakis (hydroxymethyl) phosphonium hydroxide in said aqueous composition is about 32%, the dried impregnated yarn enters the inlet tube and is wound onto a spool at a speed in excess of 2000 yards per minute, and ammonia is fed into said chamber at a rate of approximately 10 standard cubic feet per hour.

8. The process of claim 1, wherein the concentration of tetrakis (hydroxymethyl) phosphonium hydroxide in said aqueous composition is between 25 and 35% by weight.

9. The process of flame-retardant treating textile fabric comprising:

impregnating a length of textile fabric with an aqueous tetrakis (hydroxymethyl) phosphonium hydroxide composition derived from tetrakis (hydroxymethyl) phosphonium sulfate, drying the impregnated fabric to reduce its water content, then ammoniating the dried impregnated fabric by passing the fabric into an inlet slit of an ammoniating apparatus through said inlet slit into an ammonia filled chamber wherein the fabric is wound into a roll while still within said ammoniation chamber, removing the impregnated and ammoniated fabric from said chamber, oxidizing the ammoniated impregnate, and washing the fabric with water, thereby producing an uniformly flame-retardant textile fabric.

* * * * *